US006136440A

United States Patent [19]

Ito et al.

[11] Patent Number: 6,136,440

[45] **Date of Patent: *Oct. 24, 2000**

[54] RECORDING MEDIA

[75] Inventors: Katsuya Ito; Kenichi Mori; Tooru Kotani; Toshitake Suzuki; Yasushi Sasaki, all of Otu, Japan

[73] Assignee: Toyo Boseki Kabushiki Kaisha, Osaka-Fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,470

[22] Filed: Aug. 11, 1997

[30] Foreign Application Priority Data

Aug. 12, 1996 [JP] Japan ..... 8-212626
Aug. 12, 1996 [JP] Japan ..... 8-212627

[51] Int. Cl.[7] ..... B41M 5/00

[52] U.S. Cl. ..... 428/411.1; 428/195; 428/207; 428/304.4; 428/323; 428/341; 428/409; 428/480; 428/520

[58] Field of Search ..... 347/105; 428/195, 428/207, 304.4, 323, 341, 409, 411.1, 480, 520

[56] References Cited

U.S. PATENT DOCUMENTS

| | | | |
|---|---|---|---|
| 5,422,175 | 6/1995 | Ito et al. | 428/304.4 |
| 5,472,757 | 12/1995 | Ogawa et al. | 428/40 |
| 5,733,637 | 3/1998 | Moriya et al. | 428/207 |

FOREIGN PATENT DOCUMENTS

| | | | |
|---|---|---|---|
| 0 423 829 | 4/1991 | European Pat. Off. | 428/195 |
| 0 524 635 | 1/1993 | European Pat. Off. | 428/195 |
| 0 246 987 | 11/1987 | France | 428/195 |
| 0 379 964 | 8/1990 | Germany | 428/195 |
| 0 514 633 | 11/1992 | Germany | 428/195 |
| 0 631 880 | 1/1995 | Germany | 428/195 |

*Primary Examiner*—Bruce H. Hess
*Attorney, Agent, or Firm*—Morrison & Foerster LLP

[57] ABSTRACT

Recording media for use in various printing methods, each having a base film and an ink-receiving or recording layer formed thereon, characterized by their specific improved physical properties; for example, the ink drying time is 5 minutes or shorter at an amount of ink ranging from 10 g/m$^2$ inclusive to 50 g/m$^2$ exclusive, the reflection printing density is 1.3 or higher, the width of ink bleeding is 1 mm or lower, and the retention of density against water exposure is 60% or higher.

14 Claims, 2 Drawing Sheets

RECORDING MEDIA

FIELD OF INVENTION

The present invention relates to recording media, preferably recording films, and more preferably recording polyester films. More particularly, it relates to recording polyester films for use in the heat-sensitive transfer recording, heat transfer recording, sublimation transfer recording, intaglio print recording, mimeographic recording, relief print recording, lithographic recording, magnetic recording and electrostatic recording, preferably recording polyester films for use in the ink jet recording.

BACKGROUND OF THE INVENTION

In recent years, ink jet printers have bee n rapidly pervaded because of their high applicability to full color printing and their low noise in the printing. The ink jet printers take a recording system in which ink drops are discharged as a high-speed inkjet from the nozzles of the printers toward the recording materials to be printed. In such a recording system, ink has high solvent content. For this reason, recording sheets for ink jet printers are required to exhibit rapid ink absorption and excellent color development.

There is a tendency for ink jet printers to have increased discharge of ink in compliance with demands such as high resolution and high distinction. Thus, attempts are made to improve ink absorption with a recording medium in which an ink-receiving layer is formed on a base film so as to have an increased amount of coating or to contain ink particles in large quantities. Both attempts, however, result in a lowering of printing density and in an occurrence of ink bleeding.

Furthermore, in most cases, ink-receiving layers contained in the conventional recording media have poor water resistance, and images printed in the ink-receiving layers may be disordered by rain or dew. The conventional recording media can, therefore, find no outdoor applications with possible exposure to rain or dew, such as outdoor signboards.

SUMMARY OF THE INVENTION

Under these circumstances, the present inventors have intensively studied to obtain recording media having no drawbacks in the prior art, i.e., exhibiting high ink absorption, high printing density, low ink bleeding and good water resistance, thereby completing the present invention.

Thus, the present invention provides a recording medium comprising a base film and an ink-receiving layer formed thereon, characterized in that the ink drying time is 5 minutes or shorter at an amount of ink ranging from 10 $g/m^2$ inclusive to 50 $g/m^2$ exclusive, the reflection printing density is 1.3 or higher, the width of ink bleeding is 1 mm or lower, and the retention of density against water exposure is 60% or higher.

The present invention further provides another recording medium comprising a base film and an ink-receiving layer formed thereon, characterized in that the amount of coating for the ink-receiving layer is in the range of from 10 $g/m^2$ to 18 $g/m^2$ both inclusive, the bulk density of the ink-receiving layer is in the range of from 0.40 inclusive to 0.60 exclusive, and the retention of density against water exposure is 60% or higher.

The present invention further provides still another recording medium comprising a base film and an ink-receiving layer formed thereon, characterized in that the transmission printing density is 1.85 or higher, the transmission density of unprinted portions is 0.70 or lower, and the width of ink bleeding is 1 mm or lower.

The present invention further provides still another recording medium comprising a base film and a recording layer formed thereon, the recording layer being composed of water-soluble resin A, curing agent B, cationic substance C and particulate matter D, characterized in that the composition of A, B, C and D is adjusted as follows:

A/B=95/5 to 55/45;

(A+B)/C=97/3 to 60/40; and (A+B+C)/D=1/1 to 1/2.5, where "A/B" refers to the weight ratio of A to B; "(A+B)/C," the weight ratio of A and B to C; and "(A+B+C)/D," the weight ratio of A, B and C to D.

The terms "ink-receiving layer" and "recording layer" as used herein are interchangeable unless otherwise indicated.

DETAILED DESCRIPTION OF THE INVENTION

Figure 1:
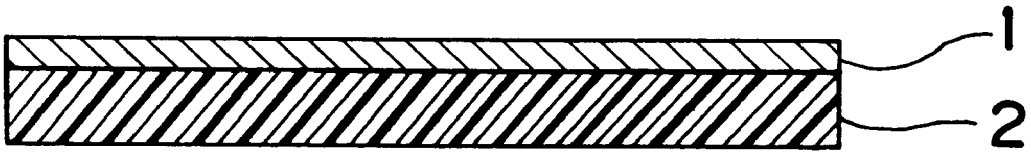
FIG. 1 is a schematic sectional view of a recording medium according to the present invention.
Figure 2:
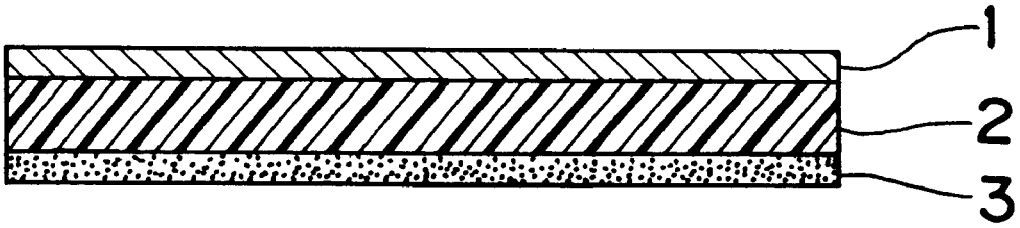
FIG. 2 is a schematic sectional view of another recording medium according to the present invention.
Figure 3:
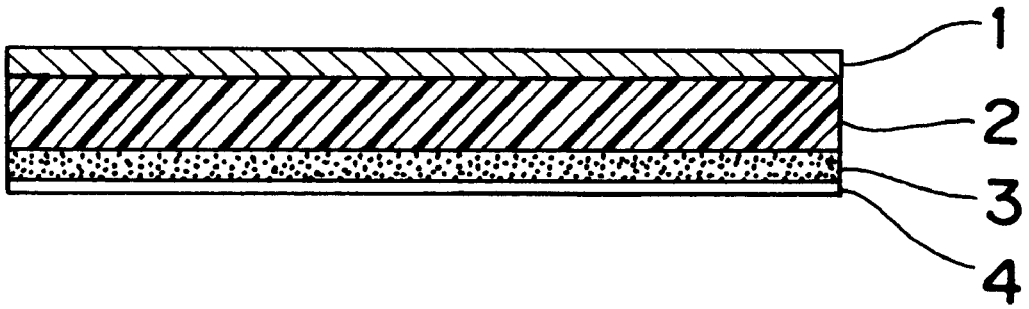
FIG. 3 is a schematic sectional view of still another recording medium according to the present invention.

The recording media of the present invention have a basic structure in which an ink-receiving layer 2 is formed on a base film 1 as shown in FIG. 1. The ink-receiving 2 may be composed of two or more sub-layers. For sticking on a wall or other surfaces, an adhesive layer 3 may be formed on the back of the base film 1 as shown in FIG. 2. In addition, a release layer 4 may be formed on the adhesive layer 3 as shown in FIG. 3, giving better handling properties.

The thickness of the ink-receiving layer may be determined in some cases by the amount of coating as defined below. In contrast, the thicknesses of the base film and the other layers are not particularly limited but may vary with conditions of printing and particular applications.

The base films which can be used in the present invention include, but are not particularly limited to, plastic films, natural paper, synthetic paper, cloths, nonwoven fabrics, woods, metals, glass, artificial leather and natural leather. These materials may be used alone or in combination by making two or more materials into a laminate. Among the base films preferably used are plastic films. The plastic films may preferably be oriented monoaxially or biaxially by the methods known in the art. Examples of the base resins used in these plastic films include, but are not particularly limited to, polyester resins, polyolefin resins, polyamide resins, polyacrylic resins, polyurethane resins, polyvinyl resins, polyether resins and polystyrene resins with particularly preferred being polyester resins such as described below.

The polyester resins which can be used in the present invention are those prepared by polycondensation of an aromatic dicarboxylic acid or an ester thereof, such as terephthalic acid, isophthalic acid or naphthalenedicarboxylic acid, with a glycol such as ethylene glycol, diethylene glycol, 1,4-butanediol or neopentyl glycol. These polyester resins can be prepared, for example, by direct reaction of an aromatic dicarboxylic acid with a glycol, or by ester interchange of an aromatic dicarboxylic acid alkyl ester with a glycol and then polycondensation, or by polycondensation of an aromatic dicarboxylic acid diglycol ester. Typical examples of the polyesters include polyethylene terephthalate, polyethylenebutylene terephthalate and polyethylene-2,6-naphthalate. These polyesters may be homopolymers or copolymers with additional monomers. In any case, preferred polyesters which can be used in the present invention contain ethylene terephthalate units, butylene terephthalate units or ethylene-2,6-naphthalate units at a ratio of 70 mol % or higher, preferably 80 mol % or higher, and more preferably 90 mol % or higher.

For the recording media of the present invention, void-containing films may preferably be used as the base film, more preferably void-containing polyester films. The void-containing films may be either single-layer films or laminated composite films.

The void-containing film which can be used in the present invention should have an apparent specific gravity of from 0.5 to 1.3 both inclusive, preferably from 0.9 to 1.3 both inclusive, and more preferably from 1.05 to 1.27 both inclusive. If the apparent specific gravity is lower than 0.5, the content of voids in the film is so high that the film shows a marked lowering in strength and some cracks or wrinkles are liable to occur on the film surface. In contrast, if the apparent specific gravity exceeds 1.3, the content of voids in the film is so low that physical properties attained by the incorporation of voids, such as cushion effect and flexibility, are deteriorated. The method for lowering the apparent specific gravity is not particularly limited but, for example, the use of recording polyester films containing microvoids in the inside is preferred, which films can be prepared by mixing a polyester resin with any resin incompatible in the polyester resin and/or with any inert particulate matter, followed by extrusion and then at least one-way orientation. In this case, the incompatible resin and inert particulate matter may be any of those known in the art; preferred are polystyrene resins and inorganic particles such as titanium dioxide powder and calcium carbonate powder.

The ink-receiving layer is formed on the base film. The ink-receiving may preferably be composed of, but not particularly limited to, water-soluble resin A, curing agent B, cationic substance C and particulate matter D.

The water-soluble resin A may be any of those known in the art. Examples of the water-soluble resin A include, but are not particularly limited to, polyester resins, polyurethane resins, polyester-urethane resins, acrylic resins, polyvinyl alcohol, acrylate resins, starch, polyvinyl butyral, gelatin, casein, ionomers, gum arabic, carboxymethyl-cellulose, polyvinyl pyrrolidone, polyacrylamide and styrene-butadiene rubber. These water-soluble resins can be used alone or in combination when necessary. For ink jet recording, preferred are polyvinyl alcohol, polyvinylpyrrolidone, and mixtures thereof.

The curing agent B may be any of those known in the art so long as it can effect curing of the water-soluble resin A. Examples of the curing agent B include, but are not particularly limited to, melamine resins, epoxy resins, blocked isocyanate group-containing resins, glyoxal and borax. Preferred are water-soluble melamine resins or methylol group-containing urea resins.

The cationic substance C may be any of those known in the art so long as it has been cationically modified. Examples of the cationic substance C include, but are not particularly limited to, cationically modified polyvinyl alcohol, cationically modified polyesters, cationically modified polyamides, diallylamine polymers, dimethyldiallyl-ammonium chloride polymers and cationically modified surfactants.

The particulate matter D may be organic or inorganic particles. Examples of the particulate matter D include, but are not particularly limited to, fine particles of titanium dioxide, calcium carbonate, silicon dioxide, barium sulfate, aluminum oxide, aluminum hydroxide, zeolite, zinc oxide, benzoguanamine, cross-linked acrylic resins and cross-linked styrene resins. These fine particles can be used alone or in combination. The average particle diameter of fine particles used is not particularly limited but is preferably in the range of from 0.2 $\mu$m to 20 $\mu$m both inclusive, more preferably from 2 $\mu$m to 15 $\mu$m both inclusive.

The components A, B, C and D may preferably be added at the following weight ratios. The weight ratio of A to B is in the range of from 95/5 to 55/45 both inclusive, preferably from 95/5 to 70/30 both inclusive. If the "A/B" weight ratio is lower 55/45, the speed of ink absorption will be lowered and the width of ink bleeding will be increased in printers with a larger amount of ink. If the "A/B" weight ratio exceeds 95/5, water resistance will be lost. The weight ratio of A and B to C is in the range of from 97/3 to 60/40 both inclusive, preferably 88/12 to 78/22 both inclusive. If the "(A+B)/C" weight ratio is lower than 60/40, ink absorption will be deteriorated. If the "(A+B)/C" weight ratio exceeds 97/3, the increased width of ink bleeding will make the printed image indistinct and water resistance will be deteriorated. The weight ratio of A, B and C to D is in the range of from 1/1 to 1/2.5 both inclusive, preferably from 1/1.2 to 1/2 both inclusive. If the "(A+B+C)/D" weight ratio is lower than 1/1, the speed of ink absorption will be lowered and the width of ink bleeding will be increased. If the "(A+B+C)/D" weight ratio exceeds 1/2.5, the printing density will be decreased.

The method for forming an ink-receiving on a base film is not particularly limited but may be carried out by any of the ordinary coating techniques used in the art, such as gravure coating, kiss coating, dip coating, spray coating, curtain coating, air-knife coating, blade coating, reverse-roll coating or bar coating.

After the coating, the ink-receiving layer may preferably be dried and heat treated under such conditions that drying temperature is adjusted within the range of from 100° to 120° C. just after the initiation of drying and then raised at a step of 10° to 20° C. up to the maximum temperature of 140° to 160° C. If these conditions are not fulfilled, the ink-receiving layer will not have optimized bulk density, nor will printing characteristics be balanced with each other. Instead of the drying temperature, the speed of drying air may be adjusted to be low in the beginning and then raised gradually.

On the back of the base film, i.e., the reverse side of the base film on which the ink-receiving layer has not been formed, there may be formed an adhesive layer. Examples of the adhesive used in the adhesive layer include, but are not particularly limited to, solvent type adhesives such as natural rubber, synthetic rubber, chloroprene rubber, acrylonitrile-butadiene rubber (NBR), butyl rubber, urethane rubber, vinyl acetate and copolymers thereof, acrylic acid and copolymers thereof; emulsion type adhesives such as natural rubber latices, chloroprene latices, acrylonitrile-butadiene rubber (NBR) latices, vinyl acetate and copolymers, acrylic acid and copolymers thereof; water-soluble adhesives such as polyvinyl alcohol, starch and glue; thermosetting resins such as epoxy resins, polyester resins, urea and melamine resins, phenol resins and polyurethane resins; hot-melt adhesives such as paraffin wax, microcrystalline wax, asphalt and resinous wax mixtures; polyethylene, and unsaturated polyesters. These adhesives may be used alone or in combination and may contain additives such as hardeners and fillers. Furthermore, an anchor coat layer may be first formed on the back of a base film and an adhesive layer may be then formed on the anchor coat layer. The anchor coat layer may be formed with any material for this purpose known in the art.

On the adhesive layer, there may be formed a release layer with any material for this purpose known in the art.

According to the present invention, it is possible to obtain recording media exhibiting high ink absorption, high printing density, low ink bleeding and good water resistance. In other words, the recording media of the present invention can also be characterized by their specific improved physical properties.

In one recording medium of the present invention, the ink drying time is 5 minutes or shorter, preferably 4 minutes or shorter, at an amount of ink ranging from mg/m$^2$ inclusive to 50 g/m$^2$ exclusive; the reflection printing density is 1.3 or higher, preferably 1.4 or higher; the width of ink bleeding is 1 mm or lower, preferably 0.5 mm or lower; and the retention of density against water exposure is 60% or higher, preferably 80% or higher. If the ink drying time exceeds 5 minutes, printed matter will be stained by a touch with the printed surface just after the printing. If the reflection printing density is lower than 1.3 or the width of ink bleeding exceeds 1 mm, printed matter is not distinctly visible. The retention of density against water exposure lower than 60% is not preferred because when the recording medium is used for outdoor signboards images printed in the ink-receiving layers may be disordered by rain or dew.

The retention of the ink-receiving layer is preferably 80% or higher, more preferably 90% or higher. The retention of the ink-receiving layer lower than 80% is not preferred because when printed matter is made into a wet laminate, i.e., a laminating film is stuck on the printed recording medium, while water placed between both is wiped off, the ink-receiving layer will be destroyed in the printed recording medium, which cannot, therefore, be applied to outdoor applications with possible exposure to rain or dew, such as outdoor signboards.

In another recording medium of the present invention, the amount of coating for the ink-receiving layer is in the range of from 10 g/m$^2$ to 18 g/m$^2$ both inclusive; the bulk density of the ink-receiving layer is in the range of from 0.40 inclusive to 0.60 exclusive; and the retention of density against water exposure is 60% or higher, preferably 80% or higher. If the amount of coating for the ink-receiving layer is lower than 10 g/m$^2$, the speed of ink absorption will be lowered and the width of ink bleeding will be increased. In contrast, if the amount of coating exceeds 18 g/m$^2$, the printing density will be decreased. If the bulk density of the ink-receiving layer is lower than 0.40, attempts to increase the printing density will increase the width of ink bleeding higher but attempts to decrease the width of ink bleeding will decrease the printing density, resulting in printed matter with poor distinction. If the bulk density of the ink-receiving layer is 0.60 or higher, the ink drying time at an amount of ink ranging from 10 g/m$^2$ inclusive to 50 g/m$^2$ exclusive will exceed 5 minutes and printed matter will be stained by a touch with the printed surface just after the printing. The retention of density against water exposure lower than 60% is not preferred because when the recording medium is used for outdoor signboards images printed in the ink-receiving layer becomes disordered with exposure to rain or dew.

In still another recording medium of the present invention, the transmission printing density is 1.85 or higher; the transmission density of unprinted portions is 0.70 or lower; and the width of ink bleeding is 1 mm or lower, preferably 0.5 mm or lower. If the transmission printing density is lower than 1.85 or the transmission density of unprinted portions exceeds 0.70, printed matter will be indistinct in applications such as illumination signboards, which are appreciated with light illuminated from the back. If the width of ink bleeding exceed 1 mm, printed matter is not distinctly visible.

The recording media thus obtained according to the present invention, which are preferably recording films and more preferably recording polyester films, can be used in the heat-sensitive transfer recording, heat transfer recording, sublimation transfer recording, intaglio print recording, mimeographic recording, relief print recording, lithographic recording, magnetic recording and electrostatic recording, preferably ink jet recording. In particular, the recording media of the present invention are most suitable for ink jet recording with pigment ink. The printed images obtained by ink jet recording with pigment ink exhibit rapid ink absorption, excellent water resistance, no ink bleeding and therefore particularly high distinction.

The physical properties of the recording media of the present invention are measured or evaluated by the following methods.

1) Apparent specific gravity

A base film is precisely cut into a square piece having a size of 5.00 cm×5.00 cm. The thickness is measured at fifty different points on the square piece and the average thickness is calculated as t $\mu$m. The weight of the square piece is measured in a scale of 0.1 mg as w g. The apparent specific gravity is calculated by the following equation.

$$\text{Apparent specific gravity}=(w\times 10000)/(5\times 5\times t)$$

2) Reflection printing density and transmission printing density

Solid black color (single color of black) is printed on a recording medium with an ink jet printer (model RJ-1300 from Mutoh Industrial Ltd.) using pigment ink.

The reflection density and transmission density are measured with a Macbeth® densito-meter model TR-927 having an orthochromatic filter for transmission of visible light. The amount of ink applied in this measurement was typically about 13 g/m$^2$.

3) Width of ink bleeding

Figure 4:
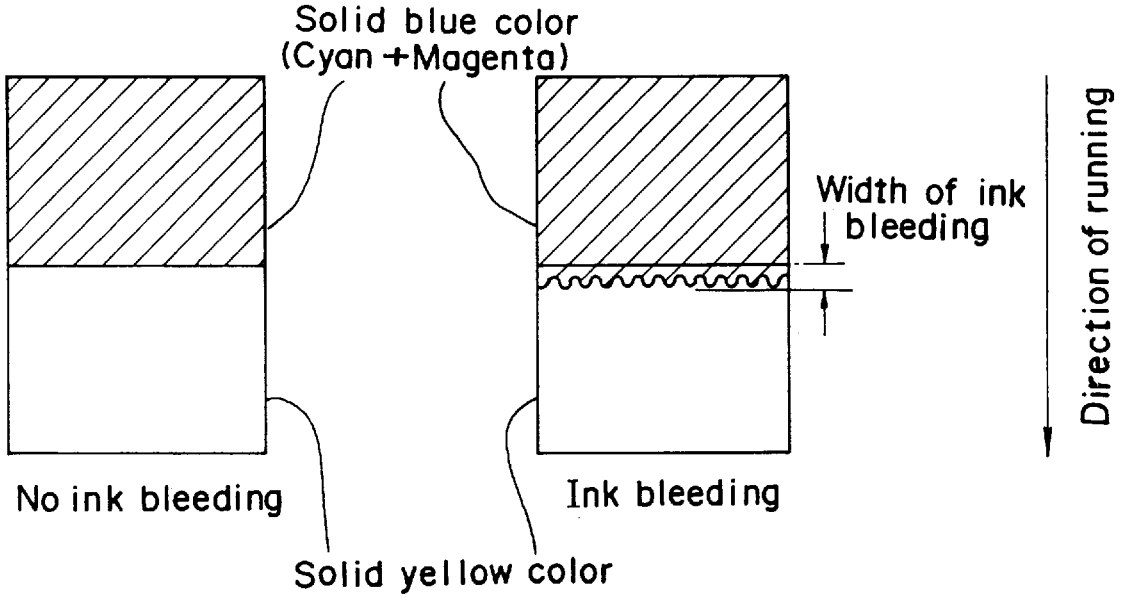
FIG. 4 is a schematic view for explanation about the definition of the width of ink bleeding.

Using an ink jet printer as described in item 2) above, solid blue color (mixed color of cyan and magenta) is printed on one half of a recording medium (hatched portion) and solid yellow color (single color of yellow) on the other half (unhatched portion). The width of ink bleeding is defined as a distance measured from the borderline between the portions as originally printed to the top crest of the ink bleeding portion in the direction of running of the recording medium as shown in FIG. 4. In this case, blue ink bleeds toward the portion printed with yellow ink.

4) Ink drying time

Solid blue color (mixed color of cyan and magenta) is printed on a recording medium with an ink jet printer as described in item 2) above. The printed portion is slightly pressed with a finger and the time period by which the ink does not adhere to the finger is measured. The amount of ink applied in this measurement was typically about 26 g/m$^2$.

5) Retention of density against water exposure

Solid black color (single color of black) is printed in a portion having a size of 5 cm×5 cm on a recording medium with an ink jet printer as described in item 2) above, and left to stand for 1 hour. A weight of 500 g/16 cm$^2$ wrapped in a piece of shirting cloth (No. 3) is placed on the printed surface of the printed matter. The weight is moved on the printed surface, while flowing water is poured onto the printed surface. At this time, the reciprocating movement is effected 10 times within a distance of 10 cm at a speed of 2 seconds/reciprocation. The reflection density of black color is measured before and after the testing with a Macbeth® densitometer model TR-927. The retention of density against water exposure is defined as the percentage of density change, i.e., (density after testing)/(density before testing)×100 (%).

6) Retention of ink-receiving layer against water exposure

Solid black color (single color of black) is printed in a portion having a size of 5 cm×10 cm on a recording medium with an ink jet printer as described in item 2) above, and left to stand for 1 hour. The printed matter is immersed in water at 20° C. for 3 hours. Thereafter, a weight of 500 g/16 cm$^2$ wrapped in a piece of shirting cloth (No. 3) is placed on the printed surface of the printed matter. The weight is moved on the printed surface, while flowing water is poured onto the printed surface. At this time, the reciprocating movement of the weight is effected 10 times over the longer dimension at a speed of 2 seconds/reciprocation. The area of the solid black colored portion is read before and after the testing with an image processing apparatus. The retention of ink-receiving layer against water exposure is defined as the percentage of area change, i.e., (area of solid black colored portion after testing)/(area of solid black colored portion before testing) x 100 (%).

7) Transmission density of unprinted portions

The transmission density is measured in the unprinted portions on a recording medium by the method as described in item 2) above.

8) Distinction of printed matter

An image containing letters and photographs is printed in a size of A1 on a recording medium with an ink jet printer as described in item 2) above. The printed matter is evaluated for distinction when viewed with reflected light from the printed matter stuck on an ordinary wall or with transmitted light by illumination of a fluorescent lamp from the back of the printed matter. The distinction of the printed matter is ranked by the following marks: ◎, if the printed image is distinct; ○, if the printed image is slightly indistinct but substantially acceptable; and X, if the printed image is scarcely distinct or indistinct.

9) Bulk density

A 10 cm×10 cm recording medium having a base film and an ink-receiving layer formed thereon is measured for the thickness in μm at ten different points with a dial gauge (Peacock from Ozaki Seisakusho Co., Ltd.) and for the weight in g. The ink-receiving layer is stripped off from the recording medium, and the thickness and weight of the recording medium having no ink-receiving layer are measured in the same manner as described above. The differences in thickness (T) and in weight (W) of the recording medium before and after the stripping are determined, and the bulk density in g/cm$^2$ of the ink-receiving layer is calculated as follows. If the thickness and weight of the recording medium are represented by $T_1$ and $T_2$ and by $W_1$ and $W_2$, respectively, before and after the stripping, the bulk density (ρ) of the ink-receiving layer is calculated by the equation:

$$T=T_1-T_2,\ W=W_1-W_2,\ \rho=W/0.01\ T.$$

10) Water resistance of printed images, Test 1

A certain image is printed on a recording medium with an ink jet printer as described in item 2) above, and left to stand for 1 hour. A laminating film (Suncutmat N5 from Lintec Co., Ltd.) is stuck on the printed surface of the recording medium. The laminate is cut into a size of 10 cm×10 cm, which is completely immersed in water for 24 hours and then taken out from the water. The water resistance of printed images is ranked by the following marks: X, if the laminating film is peeling off from the printed matter; ○, if the laminating film shows substantially no peeling; and ◎, if the laminating film shows no peeling.

11) Water resistance of printed images, Test 2

The test for water resistance is carried out in the same manner as described in item 10) above, except that a laminating film is not stuck on the printed surface of the printed matter. The water resistance of printed images is ranked by the following marks: ○, if the printed image is slightly disordered but substantially acceptable; and X, if the printed image is so disordered as to have some problem for practical purposes.

The present invention will be further illustrated by the following examples and comparative examples.

EXAMPLE 1

A polyester film (Crisper® G1211 from Toyobo Co., Ltd.; thickness, 50 μm; width, 1200 mm; length, 4000 m) was treated by corona discharge, to which treated surface was applied a mixture of 10% by weight of melamine resin (Sumitex Resin M-3 from Sumitomo Chemical Co., Ltd.) and 1% by weight of catalyst (Sumitex Accelerator ACX from Sumitomo Chemical Co., Ltd.) with 89% by weight of water so that the amount of coating was 0.1 g/m$^2$ after drying.

This surface of the polyester film was further coated with a 10% suspension of polyvinyl alcohol (GH-20 from The Nippon Synthetic Chemical Industry Co., Ltd.), melamine resin (Sumitex M-3 from Sumitomo Chemical Co., Ltd.), cationic polyamide resin (SR1005 from Sumitomo Chemical Co., Ltd.) and two kinds of silica particles respectively having an average particle diameter of 5 μm and 12 μm by means of a wire bar so that the final solid content was 10/1/2//10/10 by weight ratio. The coated polyester film was dried and heat treated in a Geer oven at 140° C. for 4 minutes so that the amount of coating was 12 g/m$^2$, resulting in a recording film.

EXAMPLE 2

A polyester film (Crisper® G1211 from Toyobo Co., Ltd.; thickness, 50 μm; width, 1200 mm; length, 4000 m) was treated by corona discharge, to which treated surface was applied a mixture of 10% by weight of melamine resin (Sumitex Resin M-3 from Sumitomo Chemical Co., Ltd.) and 1% by weight of catalyst (Sumitex Accelerator ACX from Sumitomo Chemical Co., Ltd.) with 89% by weight of water so that the amount of coating was 0.1 g/m$^2$ after drying.

This surface of the polyester film was further coated with a 10% suspension of polyvinyl alcohol (RS117 from Kuraray Co., Ltd.), dimethylolhydroxyethylene urea resin (SR5004 from Sumitomo Chemical Co., Ltd.), cationic resin (Kayafix UR from Nippon Kayaku Co., Ltd.) and two kinds of silica particles respectively having an average particle diameter of 5 μm and 12 μm by means of a wire bar so that the final solid content was 10/3/1//10/10 by weight ratio. The coated polyester film was dried and heat treated at a temperature of 100/120/140/120° C. in this order by hot air at a speed of 15 m/min. for 2 minutes in total so that the amount of coating was 14 g/m$^2$, resulting in a recording film.

EXAMPLE 3

A recording film was prepared in the same manner as described in Example 2, except that a polyester film having a thickness of 100 μm was used.

EXAMPLE 4

A recording film was prepared in the same manner as described in Example 2, except that the polyester film was replaced with a polypropyrene film (Toyopearl P6255 from Toyobo Co., Ltd.; thickness, 120 gm) and the drying temperature was changed to 80/100/120/100° C.

COMPARATIVE EXAMPLES 1 to 5

Several recording films were prepared in the same manner as described in Example 1, except that the composition by weight ratio in the ink-receiving layer was changed to those shown in Table 1. These recording films were designated Comparative Examples 1 to 5.

The physical properties of the recording films obtained in Examples 1 to 4 and Comparative Examples 1 to 5 are shown in Tables 2 and 3.

TABLE 1

| | Water-soluble resin A | Curing agent B | Cationic substance C | Particulate matter D 5 μm | Particulate matter D 12 μm |
|---|---|---|---|---|---|
| Example 1 | 10 | 1 | 2 | 10 | 10 |
| Example 2 | 10 | 3 | 1 | 10 | 10 |
| Example 3 | 10 | 1 | 2 | 10 | 10 |
| Example 4 | 10 | 1 | 2 | 10 | 10 |
| Comp. Ex. 1 | 10 | 10 | 2 | 10 | 10 |
| Comp. Ex. 2 | 10 | 0 | 2 | 10 | 10 |
| Comp. Ex. 3 | 10 | 1 | 0 | 10 | 10 |
| Comp. Ex. 4 | 10 | 1 | 2 | 5 | 5 |
| Comp. Ex. 5 | 10 | 1 | 2 | 30 | 30 |

TABLE 2

| | Apparent specific gravity | Reflection printing density | Width of ink bleeding (mm) | Ink drying time (min.) | Retention of density against water exposure (%) | Retention of ink-receiving layer (%) |
|---|---|---|---|---|---|---|
| Example 1 | 1.11 | 1.45 | 0.8 | 4 | 90 | 90 |
| Example 2 | 1.11 | 1.48 | 0.2 | 3 | 98 | 100 |
| Example 3 | 1.11 | 1.44 | 0.2 | 3 | 98 | 100 |
| Example 4 | 0.70 | 1.38 | 0.7 | 5 | 85 | 20 |
| Comp. Ex.1 | 1.11 | 1.46 | 2.0 | 10 | 95 | 100 |
| Comp. Ex.2 | 1.11 | 1.38 | 0.3 | 2 | 0 | 0 |
| Comp. Ex.3 | 1.11 | 1.30 | 1.5 | 3 | 95 | 90 |
| Comp. Ex.4 | 1.11 | 1.48 | 4.0 | 15 | 90 | 90 |
| Comp. Ex.5 | 1.11 | 0.90 | 0.2 | 3 | 95 | 95 |

TABLE 3

| | Transmission printing density | Transmission density of unprinted portions | Bulk density ($g/cm^3$) | Distinction of printed images: Reflection | Distinction of printed images: Transmission | Water resistance of printed images: Test 1 | Water resistance of printed images: Test 2 |
|---|---|---|---|---|---|---|---|
| Example 1 | 1.97 | 0.61 | 0.38 | ○ | ○ | ○ | ○ |
| Example 2 | 2.01 | 0.61 | 0.44 | ◎ | ○ | ◎ | ○ |
| Example 3 | 1.98 | 0.74 | 0.43 | ◎ | X | ◎ | ○ |
| Example 4 | 1.88 | 0.75 | 0.41 | ○ | X | X | ○ |
| Comp. Ex.1 | 2.00 | 0.60 | 0.39 | X | X | ◎ | ○ |
| Comp. Ex.2 | 1.84 | 0.61 | 0.46 | X | X | X | |
| Comp. Ex.3 | 1.80 | 0.61 | 0.36 | X | X | ○ | ○ |
| Comp. Ex.4 | 2.01 | 0.61 | 0.61 | X | X | ○ | ○ |
| Comp. Ex.5 | 1.32 | 0.61 | 0.30 | X | X | ○ | ○ |

EXAMPLE 5

An acrylic emulsion adhesive (Boncoat PS-378 from Dainippon Ink & Chemicals, Inc.) was applied to the back of the base film (i.e., the reverse side of the base film on which the ink-receiving layer had not been formed) of the recording film obtained in Example 1 was applied, and release paper was attached to the adhesive. The recording film having an adhesive layer and a release layer was tested for printability with an ink jet printer (model RJ-1300 from Mutoh Industrial Ltd.) using pigment ink, and found to exhibit excellent printability.

What is claimed is:

1. A recording medium for recording with a pigment ink, comprising a base film and an ink-receiving layer formed thereon, the ink-receiving layer comprising a water soluble resin and particulate matter, wherein the ink drying time of pigment ink on said recording medium is 5 minutes or shorter when an amount of pigment ink ranging from 10 $g/m^2$ inclusive to 50 $g/m^2$ exclusive is applied to said recording medium, the reflection printing density of pigment ink on said recording medium is 1.3 or higher, the width of ink bleeding of pigment ink on said recording medium is 1 mm or lower, and the retention of density of pigment ink on said recording medium against water exposure is 60% or higher.

2. A recording medium according to claim 1, wherein the retention of the ink-receiving layer against water exposure is 80% or higher.

3. A recording medium comprising a base film and an ink-receiving layer formed thereon, wherein the amount of coating for the ink-receiving layer is in the range of from 10 $g/m^2$ to 18 $g/m^2$ both inclusive, the bulk density of the ink-receiving layer is in the range of from 0.40 inclusive to 0.60 exclusive, and the retention of density against water exposure is 60% or higher.

4. A recording medium comprising a base film and an ink-receiving layer formed thereon, wherein the transmission printing density is 1.85 or higher, the transmission density of unprinted portions is 0.70 or lower, and the width of ink bleeding is 1 mm or lower.

5. A recording medium comprising a base film and ink-receiving layer formed thereon, the ink-receiving layer being composed of water-soluble resin A, curing agent B, cationic substance C and particulate matter D at the following weight ratios:

A/B=95/5 to 55/45;

(A+B)/C=97/3 to 60/40; and (A+B+C)/D=1/1 to 1/2.5.

6. A ink-receiving medium according to claim 5, wherein the amount of coating for the recording layer is in the range of from 10 $g/m^2$ to 18 $g/m^2$ both inclusive.

7. A recording medium according to claim 5, further comprising an adhesive layer formed on the back of the base film.

8. A recording medium according to claim 7, further comprising a release layer formed on the adhesive layer.

9. A recording medium according to claim 5, wherein the base film is an oriented plastic film.

10. A recording medium according to claim 5, wherein the base film has an apparent specific gravity ranging from 0.5 to 1.3 both inclusive.

11. A recording medium according to claim 5, wherein the base film is a void-containing polyester film.

12. A recording medium according to claim 5, wherein the water-soluble resin A is polyvinyl alcohol, polyvinyl pyrrolidone, or a mixture thereof.

13. A recording medium according to claim 5, wherein the curing agent B is a water-soluble melamine resin or a methylol group-containing urea resin.

14. A recording medium according to any one of claims 1–13, which is used for ink jet recording.

* * * * *